US007891153B2

(12) United States Patent
Cording

(10) Patent No.: US 7,891,153 B2
(45) Date of Patent: Feb. 22, 2011

(54) ENERGY-FREE REFRIGERATION DOOR AND METHOD FOR MAKING THE SAME

(75) Inventor: Christopher R. Cording, Kingsport, TN (US)

(73) Assignee: AGC Flat Glass North America, Inc., Alpharetta, GA (US)

( * ) Notice: Subject to any disclaimer, the term of this patent is extended or adjusted under 35 U.S.C. 154(b) by 1591 days.

(21) Appl. No.: 10/777,210

(22) Filed: Feb. 13, 2004

(65) Prior Publication Data

US 2004/0222724 A1 Nov. 11, 2004

Related U.S. Application Data

(63) Continuation of application No. 10/400,067, filed on Mar. 27, 2003, now abandoned, which is a continuation of application No. 09/909,262, filed on Jul. 19, 2001, now abandoned.

(51) Int. Cl.
*E04G 21/00* (2006.01)

(52) U.S. Cl. ..... 52/741.4; 52/171.2; 52/171.3; 52/204.6; 52/204.71

(58) Field of Classification Search ..... 52/171.2, 52/171.3, 204.5, 204.6, 204.71, 786.1; 428/447, 428/448, 429

See application file for complete search history.

(56) References Cited

U.S. PATENT DOCUMENTS 3,992,171 A 11/1976 Jenewein (Continued)

FOREIGN PATENT DOCUMENTS

CA 1139346 A 1/1983

(Continued)

OTHER PUBLICATIONS

U.S. Appl. No. 11/396,914, titled "Anti-Fog Refrigeration Door and Method of Making the Same"; Cording, Christopher.*

(Continued)

*Primary Examiner*—Richard E Chilcot, Jr.
*Assistant Examiner*—William V Gilbert
(74) *Attorney, Agent, or Firm*—Rothwell, Figg, Ernst & Manbeck p.c.

(57) ABSTRACT

The energy-free refrigeration door of the present application provides a way to control condensation when the door of a refrigeration unit is opened by providing thermal insulation, to the door with glass panels which have a low emissivity coating. The door includes a door frame housing and an insulating glass unit comprising inner, middle and outer sheets of glass. A first sealant assembly disposed around the periphery of the inner and middle sheets of glass forms a first chamber between the inner and middle sheets of glass. A second sealant assembly disposed around the periphery of the middle and outer sheets of glass forms a second chamber between the middle and outer sheets of glass. A gas, such as krypton, air, or argon is held in the first and second chambers. The outer sheet of glass and inner sheet of glass each have an unexposed surface that faces the middle sheet of glass. A low emissivity coating is disposed on the unexposed surfaces of the inner and outer sheets of glass so that the glass door as a whole has a U value that prevents formation of condensation on the outer surface of the outer sheet of the glass door, without the application of electricity to heat the door, while also providing the desired evaporation rate of condensation from the inner side of the inner sheet of the glass door.

141 Claims, 4 Drawing Sheets

U.S. PATENT DOCUMENTS

| | | | | |
|---|---|---|---|---|
| 4,024,494 | A | 5/1977 | Quesnel | |
| 4,035,608 | A | 7/1977 | Stromquist et al. | |
| 4,053,972 | A | 10/1977 | Kordes | |
| 4,081,934 | A | 4/1978 | Franz | |
| 4,134,626 | A | 1/1979 | Kordes | |
| 4,477,129 | A * | 10/1984 | Heaney | 312/116 |
| 4,583,796 | A | 4/1986 | Nakajima et al. | |
| 4,656,781 | A | 4/1987 | Niekrasz et al. | |
| 4,831,799 | A | 5/1989 | Glover et al. | |
| 4,859,532 | A | 8/1989 | Oyama et al. | |
| 5,113,628 | A * | 5/1992 | Richardson et al. | 52/171.3 |
| 5,117,587 | A | 6/1992 | Doan | |
| 5,157,940 | A | 10/1992 | Bertu et al. | |
| 5,732,517 | A | 3/1998 | Milikovsky | |
| 5,778,689 | A | 7/1998 | Beatenbough | |
| 5,784,896 | A | 7/1998 | Tronnes et al. | |
| 5,806,256 | A | 9/1998 | Byrne | |
| 5,806,272 | A | 9/1998 | Lafond | |
| 5,852,284 | A | 12/1998 | Teder et al. | |
| 6,052,965 | A | 4/2000 | Florentin et al. | |
| 6,094,306 | A | 7/2000 | Jain | |
| D430,174 | S | 8/2000 | Negrao et al. | |
| 6,144,017 | A | 11/2000 | Millett et al. | |
| 6,148,563 | A | 11/2000 | Roche et al. | |
| 6,164,739 | A | 12/2000 | Schulz et al. | |
| 6,185,948 | B1 | 2/2001 | Niki et al. | |
| 6,210,784 | B1 | 4/2001 | Rondeau et al. | |
| 6,238,755 | B1 | 5/2001 | Harvey et al. | |
| 6,260,255 | B1 | 7/2001 | Richardson et al. | |
| 6,362,414 | B1 | 3/2002 | Fujisawa et al. | |
| 6,367,223 | B1 | 4/2002 | Richardson et al. | |
| 6,401,399 | B1 | 6/2002 | Roche et al. | |
| 6,401,428 | B1 | 6/2002 | Glover et al. | |
| 6,606,832 | B2 | 8/2003 | Richardson et al. | |
| 6,606,833 | B2 | 8/2003 | Richardson et al. | |
| 6,830,791 | B1 * | 12/2004 | Misonou et al. | 428/34 |
| 2002/0073645 | A1 | 6/2002 | Richardson et al. | |
| 2002/0078654 | A1 | 6/2002 | Richardson et al. | |
| 2004/0214010 | A1 | 10/2004 | Murata et al. | |

FOREIGN PATENT DOCUMENTS

| | | | |
|---|---|---|---|
| EP | 0036657 | A2 | 9/1981 |
| EP | 0261923 | A2 | 3/1988 |
| EP | 0448808 | A2 | 10/1991 |
| EP | 0870450 | A1 | 10/1998 |
| EP | 0995724 | A1 | 4/2000 |
| FR | 2609285 | A1 | 7/1988 |
| GB | 2199360 | A | 7/1988 |
| GB | 2286008 | A | 8/1995 |
| SE | 8201588 | A | 9/1983 |
| WO | 01/93727 | A2 | 12/2001 |

OTHER PUBLICATIONS

Web page describing TBWE3 ComfortSeal® spacer, Jul. 7, 2000.
Edgetech Newsletter, vol. 2, No. 4, pp. 1-2 (Summer 1992).
Article entitled, "Edgetech give warm edge," Glass Age & Window Construction, Apr. 2000, vol. 43, Part 4.
Marketing Pamphlet: "AFG & TruSeal Have Redefined Warm-Edge," 4 pages.
Marketing Pamphlet: "Comfort Seal Insulating Glass Edge Seal System," Mar. 2000, printed in the USA, 2 pages.
Marketing Pamphlet: "A Spacer System with a Dual Personality," 4 pages.
United States Statutory Invention Registration No. H975 to Selkowitz et al., published Nov. 5, 1991, 8 pages.
European Patent Opposition, submitted in relation to European Patent No. 1421321 B1 (European App. No. 02756503.5) on Sep. 23, 2010, 25 pages.
European Patent Opposition, submitted in relation to European Patent No. 1421321 B1 (European App. No. 02756503.5) on Sep. 23, 2010, 25 pages. (English translation from French).
European Communication of a Notice of Opposition, issued in European Patent No. 1421321 B1 (European App. No. 02756503.5) on Sep. 28, 2010, 1 page.
Extract from the Grand Dictionnaire Terminologique - definition of emissivity, 2 pages. (English translation from French included).

* cited by examiner

ENERGY-FREE REFRIGERATION DOOR AND METHOD FOR MAKING THE SAME

CROSS-REFERENCE TO RELATED APPLICATIONS

This application is a continuation of application Ser. No. 10/400,067, filed Mar. 27, 2003, which is a continuation of application Ser. No. 09/909,262, filed Jul. 19, 2001, the contents of both of which are incorporated herein by reference in their entirety.

BACKGROUND OF THE INVENTION

1. Field of the Invention

The present invention relates, generally, to refrigeration doors and, in particular, to an energy-free refrigeration door providing condensation control, thermal insulation, and a desired amount of visible transmittance. More particularly, the refrigeration door of the present invention achieves these desired characteristics through the application of a low-emissivity coating, without electrically heating the door. Throughout this application the term "refrigeration door" is meant to refer to a door used for freezers, refrigerators and similar units and cabinets. In addition, for purposes of this application the term "energy-free" (as in energy-free refrigeration door) means that electricity is not applied to the glass to heat the glass.

2. Discussion of the Background

Refrigeration doors for commercial freezers, refrigerators and the like are typically constructed of glass to allow the customer to view the products placed therein for sale without opening the door. However, when condensation forms on the glass (sometimes referred to as "fogging"), the customer is not able to see through the door to identify the products inside, which is undesirable from the standpoint of the customer and the store owner or retailer as well.

Moisture condenses on the outside of the glass refrigeration door because the surface temperature of the outside of the glass is reduced below the ambient temperature in the store by the colder refrigerated interior of the freezer or refrigerator. When the temperature of the surface of the glass drops below the dew point of the air in the store, moisture condenses on the surface of the glass. In addition, when a door is opened in a humid environment, the innermost sheet of glass, which forms the inside of the door, is also momentarily exposed to the ambient air of the store and condensation may form on the inside of the door as well. The condensation on the inside of the glass door also occurs because the temperature of the inside of the glass door is below the dew point of the ambient store air to which it is exposed.

As previously indicated, condensation on the glass door, which may become frost, prevents the customer from seeing the products for sale through the glass door. Consequently, when condensation or frost is on the glass door, the customer must perform the unpleasant task of opening the refrigeration door to identify the contents inside, which is impractical in a store with a large number of freezers or refrigerators. Not only is opening every refrigeration door tedious and time consuming from the customer's perspective, it is undesirable from the retailer's freezers and refrigerators, thereby resulting in higher energy costs to the retailer.

There are various industry performance standards which refrigeration doors are required to comply with in order to be acceptable. In the United States, much of the industry requires freezer doors (but not refrigerator doors) that prevent external condensation when used in an environment with an outside temperature of eighty degrees Fahrenheit (80 F), an outside relative humidity of sixty percent (60%), and an inside temperature of minus forty degrees Fahrenheit (−40 F). Other countries have different requirements.

As is well known in the art, a typical refrigeration door is comprised of an insulating glass unit (IGU) housed in a door frame. The IGU in a refrigeration door is, typically, comprised of two or three sheets of glass sealed at their peripheral edges by a sealant assembly, generally referred to as an edge seal. In an IGU comprised of three sheets fo glass, two insulating chambers as formed between the three sheets of glass. In an IGU comprised of two sheets of glass, a single insulating chamber is formed. Typically, IGUs for refrigerators are constructed of two sheets of glass, while IGUs for freezers employ three sheets of glass. Once sealed, the chambers are often filled with an inert gas such as argon, krypton, or other suitable gas to improve the thermal performance of the IGU.

Most conventional approaches to preventing or reducing condensation in a refrigeration door involve supplying energy to the door by including a conductive coating on one or more of the glass surfaces of the IGU for electrically heating the glass. The purpose of heating the glass is to maintain the temperature of the glass above the dew point of the warmer ambient air of the store. By heating the glass above the dew point, the undesirable condensation and frost are prevented from forming on the glass in the door, providing a clear view through the glass to the interior of the refrigeration compartment.

In a door consisting of a three-paned IGU, an unexposed surface of one or two of the sheets of glass is coated with a conductive material. The conductive coating is connected to a power supply by two bus bars or other electrical connectors mounted on opposite edges of the glass. As current passes through the coating, the coating heats, thereby heating the glass sheet to provide a condensation-free surface. The coating on the IGU of a refrigeration door is normally applied to the unexposed surface of the outermost glass sheet. However, because condensation sometimes forms on the inside of the inner sheet of glass, the unexposed surface of the innermost sheet of glass may also be coated for heating to prevent condensation.

There are numerous drawbacks and problems associated with these conventional heated refrigeration doors of the prior art. First, heating the door incurs an energy coast above and beyond the energy costs of the cooling system. In a standard size commercial freezer, the additional cost to heat a freezer door is substantial—based on current electrical utility pricing, such additional costs can be $100 per year or more for each freezer. Considering that many stores utilize multiple freezers, with some supermarkets and other food retailers utilizing hundreds of freezers, the cumulative energy costs associated with such heated freezer doors are significant.

Second, excess heat from conventional heated refrigeration doors will migrate to the refrigeration compartment, creating an additional burden on the cooling system, which results in still greater energy costs. Third, if the power suppled to the door for heating is too low, is turned off, or is shut down due to a power outage, condensation and/or frost will form on the glass. If the power dissipation is too high, unnecessary additional energy costs will be incurred. In order to reduce the occurrence of these problems, such heated glass doors often require precise control of the door heating system. In order to achieve the necessary precise control of the door heating system, an electrical control system is required, which results in increased design and manufacturing costs, as well as substantial operational and maintenance costs.

Fourth, these electrically heated glass doors present a safety hazard to customers and a potential risk of liability and exposure to retailers and refrigeration system manufacturers. The voltage applied to the glass door coating is typically 115 volts AC. The shopping carts used by customers in stores are heavy and metal. If the shopping cart strikes and breaks the glass door, electricity may be conducted through the car to the customer, which could cause serious injury or even death.

U.S. Pat. No. 5,852,284 and U.S. Pat. No. 6,148,563 disclose applying a voltage to a glass coated with a conductive coating (which may be a low emissivity coating) to control the formation of condensation on the outer surface of the glass door. The conductive coating, such as a low emissivity coating, provides a resistance to the electricity, which produces heat, while also providing desirable thermal characteristics. However, the refrigeration doors disclosed in these patents suffer from the previously described drawbacks and problems associated with all electrically heated refrigeration doors.

In addition to being used for conductivity, such low emissivity coatings have been employed as another means for reducing condensation on refrigeration doors. Specifically, one method of increasing the insulating value of glass (the "R value"), and reducing the loss of heat from the refrigeration compartment, is to apply a low emissivity (low E) coating to the glass. A low E coating is a microscopically thin, virtually invisible metal or metallic oxide layer(s) deposited on a glass surface to reduce the emissivity by suppressing radiative heat-flow through the glass. Emissivity is the ratio of radiation emitted by a black body or a surface and the theoretical radiation predicted by Poanck's law. The term emissivity is used to refer to emissivity values measured in the infrared range by the American Society for Testing and Materials (ASTM) standards. Emissivity is measured using radiometric measurements and reported as hemispherical emissivity and normal emissivity. The emissivity indicates the percentage of long infrared wavelength radiation emitted by the coating. A lower emissivity indicates that less heat will be transmitted through the glass. Consequently, the emissivity of a sheet of glass or of an IGU impacts the insulating value of the glass or IGU as well as the heat conductivity (the "U value") of the glass or IGU. The U value of a sheet of glass or of an IGU is the inverse of its R value.

In a multi-pane IGU, the emissivity of the IGU, which is the combined emissivity of the sheets of the glass that form the IGU, may be approximated by multiplying the emissivity of all the sheets of glass together. For example, in a two-sheet IGU with each sheet of glass having an emissivity of 0.5, the total emissivity would be 0.5 multiplied by 0.5 or 0.25.

While low E coatings have been applied to IGUs used in refrigeration doors both with and without electrically heating the doors, such coatings and IGUs are not capable of controlling condensation and providing the required thermal insulation through the broad range of temperatures and environments in which such refrigeration doors are utilized without applying electricity to heat the doors. More specifically, notwithstanding the use of such low E coatings, refrigeration doors that are not heated have failed to provide condensation control in applications in which the interior temperature of the refrigeration compartment is substantially near or below freezing.

Thus, notwithstanding the available electrically heated and low emissivity coated refrigeration doors, there is a need for a refrigeration door: (1) that provides the necessary condensation control and thermal insulation over a broad range of temperatures and environments; (2) with the desired amount of visible transmittance; (3) that avoids unnecessary energy costs and undue burden on the cooling system by eliminating the need for supplying electrical power to heat the door; (4) that does not require an expensive and complex electrical control system, thereby minimizing design, manufacturing, operation, and maintenance costs; and (5) that does not present a safety hazard to customers and a potential risk of liability and exposure to manufacturers and retailers.

SUMMARY OF THE INVENTION

The primary objective of the present invention is overcome the deficiencies of the prior art described above by providing an energy-free refrigeration door with condensation control, thermal insulation, and a desired amount of visible transmittance.

Another key objective of the present invention is to provide a refrigeration door that does not employ electrical energy in order to reduce condensation on the glass.

Another key objective of the present invention is to provide a refrigeration door that controls condensation and that does not transfer significant heat to the interior of the freezer or refrigerator, thereby further burdening the cooling system and increasing energy costs.

Still another objective of the present invention is to provide a refrigeration door with condensation control that is easier and more economical to manufacture, operate, and maintain than the prior art refrigeration doors and systems.

Yet another objective of the present invention is to provide a refrigeration door with condensation control that is easier to design, operate, and maintain.

Another objective of the present invention is to provide a method for making a refrigeration door with condensation control that does not use electricity to heat the glass to control the condensation.

Yet another objective of the present invention is to provide a refrigeration door with an emissivity of less than 0.04.

Still another objective of the present invention is to provide a refrigeration door with an emissivity of approximately 0.0025.

Yet another objective the present invention is to provide a refrigeration door with a U value of less than 0.2 BUT/hr-sq ft-F.

Still another objective of the present invention is to provide a refrigeration door with a U value of approximately 0.16 BTU/hr-sq ft-F.

The present invention achieves these objectives and others by providing an energy-free refrigeration door, and method for making the same, comprising a door frame housing an insulating glass unit comprising inner, middle and outer sheets of glass. A first sealant assembly disposed around the periphery of the inner and middle sheets of glass forms a first chamber between the inner and middle sheets of glass. A second sealant assembly disposed around the periphery of the middle and outer sheets of glass forms a second chamber between the middle and outer sheets of glass. A gas, such as krypton, air, or argon is held in the first and second chambers. The outer sheet of glass and inner sheet of glass each have an unexposed surface that faces the middle sheet of glass. A low emissivity coating is disposed on the unexposed surfaces of the inner and outer sheets of glass so that the glass door as a whole has a U value that prevents formation of condensation on the outer surface of the outer sheet of the glass door, without the application of electricity to heat the door, while also providing the desired evaporation rate of condensation from the inner side of the inner sheet of the glass door.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements.

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
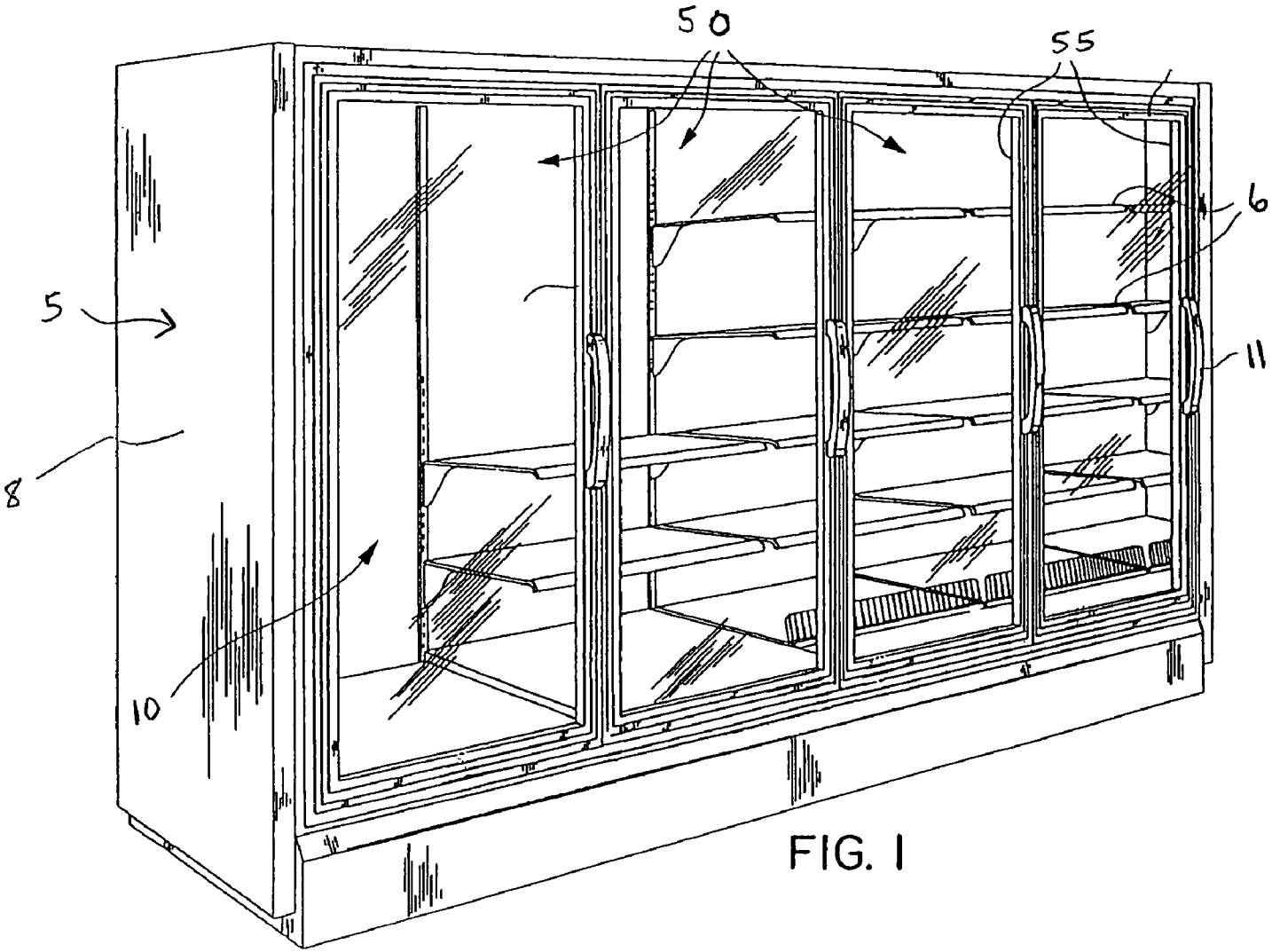
FIG. 1 depicts a refrigeration system employing the present invention.

In the following description, for purposes of explanation and not limitation, specific details are set forth, such as particular coatings, coating processes, sheet thicknesses, seal assemblies, number of sheets, sheet spacings, and methods for assembling the door, etc. in order to provide a thorough understanding of the present invention. However, it will be apparent to one skilled in the art that the present invention may be practiced in other embodiments that depart from these specific details. Detailed descriptions of well-known coatings, coating processes, sealant assemblies, and methods for assembling the door are omitted so as not to obscure the description of the present invention. For purposes of this description of the invention, terms such as external, internal, outer, and inner are descriptions from the perspective of the inside of the freezer or refrigerator compartment as is evident from the figures.

Testing, as well as computer modeling, has shown that a U value (the conductivity of transfer of heat through the glass) of approximately 0.2 BTU/hr-sq ft-F is required for the refrigeration door to prevent condensation on the outside of the glass under the performance requirements for the United States industry as described above. As discussed, however, when the door is opened, condensation may form on the inside of the inner sheet of glass of the door because the temperature of the inner surface of the sheet is below the dew point of the more humid ambient store air to which it is exposed. The condensation, however will dissipate once the door is closed as the moisture evaporates into the freezer or refrigerator compartment.

While the condensation is present on the inside of the door, the contents of the freezer or refrigerator are not visible through the door. Consequently, the speed of the evaporation, which determines the length of time during which the condensation is present, is an important design criterion. The more heat that is transferred through the glass door to the inner surface of the glass door, the faster the condensation on the inside of the door will evaporate. However, increased heat transfer through the door also results in increased energy costs from the cooling system. Consequently, the optimal U value of the glass door will be driven by numerous factors including the difference between the outside and inside temperatures, the glass thickness, the spacing, the gas(es) used in the chamber(s) of the IGU, the number of sheets, the spacer material, the ambient humidity, the absorption coefficient of the coating in the far infrared spectrum, as well as the desirable time for evaporation of the condensation. In addition, the costs associated with the selected components (i.e., the gas, the sealant assembly, the glass, etc.), the energy costs, and other factors are also design considerations. The preferred embodiment described below provides a U value of 0.16 BTU/hr-sq ft F that prevents condensation on the outside of the door, while permitting enough heat to penetrate through the door from the ambient external environment to allow condensation on the inside of the door to evaporate in a reasonable amount of time. Some refrigeration system manufacturers require that the condensation evaporate within a few minutes and others require evaporation within one minute. The time required for the condensation to evaporate will vary according to the amount of time the door is open, the humidity in the store, the refrigeration system compartment temperature, the refrigeration system contents, the heat transferred through the door (which is dependent on the U value), and other factors.

Figure 2:
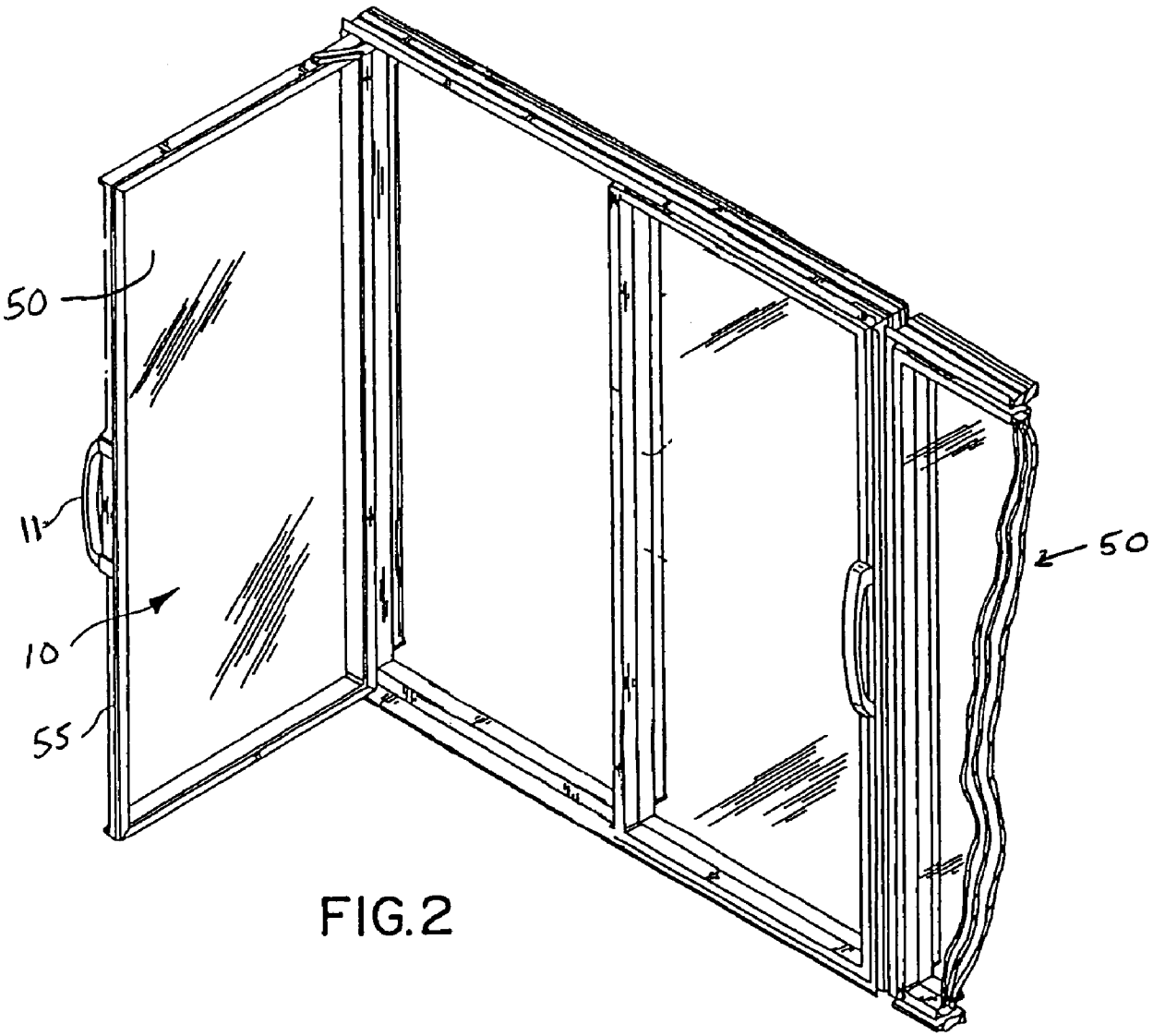
FIG. 2 depicts a refrigeration door according to the present invention.

In the preferred embodiment of the present invention, as shown in FIG. 1, a refrigeration system 5 includes a plurality of transparent refrigeration doors 10 with each having a handle 11. As will be discussed in more detail below, each refrigeration door 10 includes an IGU 50 mounted in a frame 55. The interior of the refrigeration system includes a plurality of shelves 6 for holding merchandise to be seen through the door. Referring to FIG. 2, the refrigeration door 10 of the present embodiment is mounted to the opening of the refrigeration system with a hinge, which allows the door to open outwards.

Figure 3:
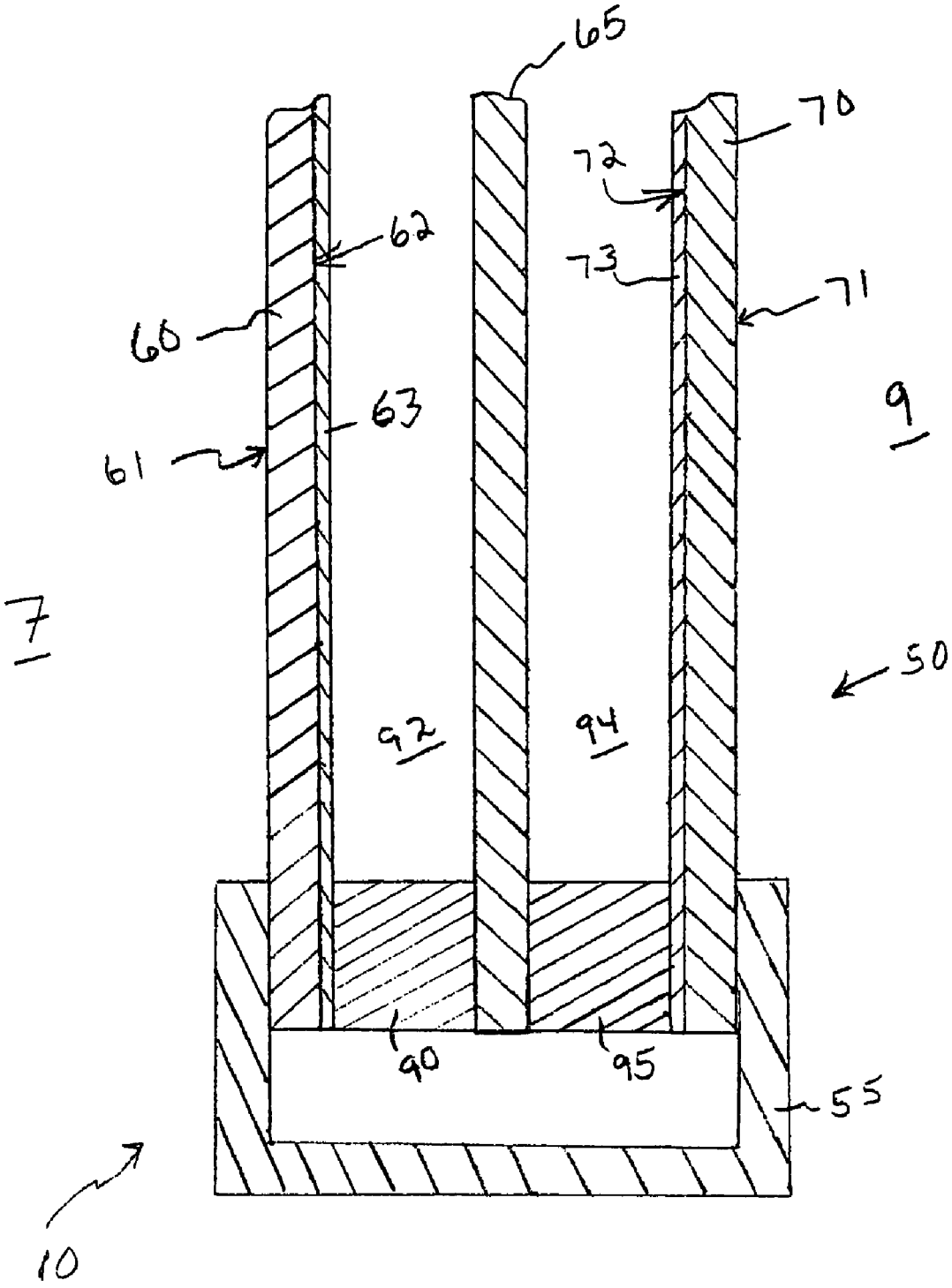
FIG. 3 is an illustration of a partial cross-sectional view of a refrigeration door according to the present invention.

As discussed above, the refrigeration door 10 includes an IGU 50 housed in a frame 55. As shown in FIG. 3, the IGU 50 is comprised of an outer sheet of glass 60, a middle sheet of glass 65, and an inner sheet of glass 70. The IGU 50 is housed in frame 55 and also includes a first sealant assembly 90 that extends around the periphery of the inner surface 62 of the outer sheet 60 and the outer surface of the middle sheet 65 of glass to define a substantially hermetically sealed insulated outer chamber 92. Similarly, a second sealant assembly 95 extends around the periphery of the outer surface 72 of the inner sheet 70 and inner surface of the middle sheet 65 of glass to define a substantially hermetically sealed insulated inner chamber 94.

The outer surface 61 of the outer sheet of glass 60 is positioned adjacent the external ambient environment 7. In other words, the outer surface 61 of the outer sheet of 60 is exposed to the environment in which the refrigerator or freezer resides. The inner surface 62 of the outer sheet 60 forms part of, and is exposed to, the outer chamber 92.

In this preferred example embodiment, the outer sheet 60 is one eighth of an inch thick, tempered, and the inner surface 62 of the outer sheet 60 is coated with a low emissivity coating 63. Specifically, in this embodiment, the low E coating is a sputter-coated low E coating that includes an ultra-hard titania as the base layer to ensure a high level of thermal performance and a high visible transmittance. This particular sputter coated glass can be tempered after the coating and offers high visible light transmission without high levels of color tinting. The outer surface 61 of outer sheet 60 is not coated. In this embodiment, the outer sheet 60 may, for example, be a sheet of Comfort Ti-PS glass, one eighth of an inch thick, manufactured by AFG Industries, Inc. of Kingsport, Tenn., which has a low E coating providing an emissivity of 0.05. As is well-known in the art, the Comfort Ti-PS is cut to the appropriate size, tempe4red, and edged before being integrated into the IGU 50.

The middle sheet of glass 65 is positioned between the outer 60 and inner 70 sheets of glass and forms part of the outer chamber 92 and the inner chamber 94. The middle sheet 65 is spaced one half inch from the outer sheet 60 and inner sheet 70 and is a one eighth of an inch thick, uncoated, sheet of tempered glass.

The inner sheet of glass 70 is positioned adjacent the interior of the freezer or refrigerating compartment 9, with its inner surface 71 exposed to the interior of the compartment 9. The outer surface 72 of the inner sheet 70 forms part of, and is exposed to, the inner chamber 94. The outer surface 72 of the inner sheet 70 of glass is also coated with a low emissivity coating 73. In this embodiment, the coating 73 on the outer surface 72 of the inner sheet 70 is the same as that described above with respect to the coating 63 of the inner surface 62 of the outer sheet 60. The inner surface 71 of inner sheet 70 is not coated. In this embodiment, the inner sheet 70 may also, for example, be a sheet of Comfort Ti-PS, one eighth of an inch thick, manufactured by AFG Industries, Inc., which has the described characteristics and coating.

In this example embodiment, the chambers 92 and 94 are both filled with air. In alternative embodiments, each chamber may be filled with a different gas and the chambers could be filled with krypton, argon, or other suitable gas.

The sheets 60, 65 are held apart by a first sealant assembly 90 which extends around the periphery of the sheets 60, 65 maintaining the glass sheets in parallel, spaced-apart relationship creating chamber 92 between the sheets 60, 65, while also sealing the chamber 92 from the external environment. Likewise, the sheets 65, 70 are held apart by a second sealant assembly 95 which extends around the periphery of the sheets 65, 70 maintaining the glass sheets in parallel, spaced-apart relationship creating chamber 94 between the sheets 65, 70 while also sealing the chamber 94 from the external environment. The sealant assemblies 90, 95 maintain a one half inch space between the outer sheet 60 and middle sheet 65 and inner sheet 70 and middle sheet 65, respectively.

The sealant assemblies 90, 95 of the present embodiment are preferably, warm edge seals. "Warm edge" is used to describe an insulating glass sealing assembly that reduces heat loss better than conventional aluminum spacers and sealant combinations. Each of the sealant assemblies 90, 95 of this embodiment includes its own spacer and desiccant, which replaces the need for a separate sealant, metallic spacer, and desiccant, and has a heat transfer rate of 0.84 Btu/hr-ft-F (sometimes referred to as K value). The sealant assemblies 90, 95 in this embodiment are a composite extrusion containing a combination of polyisobutylene sealant, hot melt butyl sealant, desiccant matrix, rubber shim and a vapor barrier. Suitable sealant assemblies of this type are manufactured and sold by TruSeal Technologies of Beachwood, Ohio, under the name "Comfort Seal."

Referring to FIG. 3, IGU 50 is shown. IGU 50 is comprised of glass sheets 60, 65, and 70 integrated by sealant assemblies 90 and 95. IGU 50 is installed in frame 55 in any suitable manner well-known to those skilled in the art. The frame 55 is made from extruded plastic or other suitable well-known frame materials, such as extruded aluminum, fiber glass or other material. If, in any alternative embodiment the frame 55 is formed of aluminum or other material, the door may require heating along its edges to ensure condensation control around the edges of the door.

Referring to FIG. 1, a refrigeration system 5 is shown. The door frame 55 is coupled to the refrigeration compartment 8 in any suitable fashion as is well known in the art, such as a single door long hinge, multiple hinges, or ain a slot for sliding the door open and closed. In addition, the frame may include a door handle 11 or other suitable actuating means as is appropriate for the application. The refrigeration system 5, of which the door 10 forms a part, may be any system used for cooling a compartment, such as that disclosed in U.S. Pat. No. 6,148,563, which is hereby incorporated herein by reference.

The above preferred embodiment provides a refrigeration door with a U value of 0.16 BTU/hr-sq ft-F (and emissivity of 0.0025), which has been found to be suitable for freezer door applications requiring the performance standards identified above with respect to the United States industry. A U value of 0.16 BTU/hr-sq ft-F permits the refrigeration door to easily met the required performance standards, while also allowing enough heat to penetrate through the door with the external ambient environment to evaporate condensation formed on the inside of the door in a reasonable time period. In addition, the preferred embodiment provides a visible light transmittance of sixty-six percent (66%).

As an alternative t the Comfort Ti-PS glass, other low E coated glass may be used, such as, for example, Comfort Ti-R, Comfort Ti-AC, Comfort Ti-RTC, and Comfort Ti-ACTC, all of which are available from AFG Industries, Inc., which like Comfort Ti-PS, are titania/silver based low E coated glass manufactured by AFG Industries, Inc. Another suitable type of glass is Comfort E2, which is coated with a pyrolytic process and is a fluorine doped tin oxide low E coated glass, one eighth of an inch thick, and which is manufactured by AFG Industries, Inc. Comfort E2 is suitable for some of the less stringent performance standards because of its higher emissivity.

The U value of the refrigeration door 10 is determined by a number of design factors including the number of sheets of glass, the thickness of the sheets, the emissivity of the IGU, the spacing between the sheets, and the gas in the chamber(s). In the three pane refrigeration door 10 of the preferred embodiment described above, the U value of 0.16 BTU/hr-sq ft-F is accomplished using air as the gas being held in the chambers, glass thicknesses of one eighth of an inch on all sheets, one half inch spacing, and an IGU emissivity of 0.0025. However, each of these factors can be varied resulting in numerous permutations of values that could be combined to provide the same U value. In addition, other applications may require a smaller or larger U value depending on the environment, costs constraints, and other requirements or considerations.

A number of computer simulations have been performed to determine the U values of numerous IGUs for use in refrigeration doors 10 with a range of values of each of the various design parameters combined in different permutations. The table below includes the design parameters and corresponding calculated U values for a number of three pane IGU configurations. In addition to the design parameters listed in Table 1 below, all of the three pane IGU U value calculations were computed with each pane being one eighth of an inch thick, and a total of two sides of the three panes being low E coated. Tempering of the glass does not significantly effect the calculated performance values.

TABLE 1

| Spacing between Sheets (inches) | Gas in Chambers | Type of Coating | Emissivity of IGU | U value (Btu/hr-sq ft-F) |
|---|---|---|---|---|
| 1/2 | air | Ti-PS | 0.0025 | 0.16 |
| 5/16 | air | Ti-PS | 0.0025 | 0.22 |
| 1/2 | argon | Ti-PS | 0.0025 | 0.12 |
| 5/16 | argon | Ti-PS | 0.0025 | 0.17 |
| 1/2 | krypton | Ti-PS | 0.0025 | 0.11 |
| 5/16 | krypton | Ti-PS | 0.0025 | 0.11 |
| 1/2 | air | CE2 | 0.04 | 0.20 |
| 5/16 | air | CE2 | 0.04 | 0.26 |
| 1/2 | argon | CE2 | 0.04 | 0.17 |
| 5/16 | argon | CE2 | 0.04 | 0.21 |
| 1/2 | krypton | CE2 | 0.04 | 0.15 |
| 5/16 | krypton | CE2 | 0.04 | 0.15 |

In each of the tables included herein, "Ti-PS" refers to the low E coating of AFG Industries' Comfort Ti-PS glass and "CE2" refers to the low E coating of AFG Industries' Comfort E2 glass, both described above. In addition, the U values in the tables are calculated as "center of the glass" values, because the computer simulation does not have the capability to consider the sealant assembly. Consequently, there are no sealant assembly data or design criteria listed in the tables.

Figure 4:
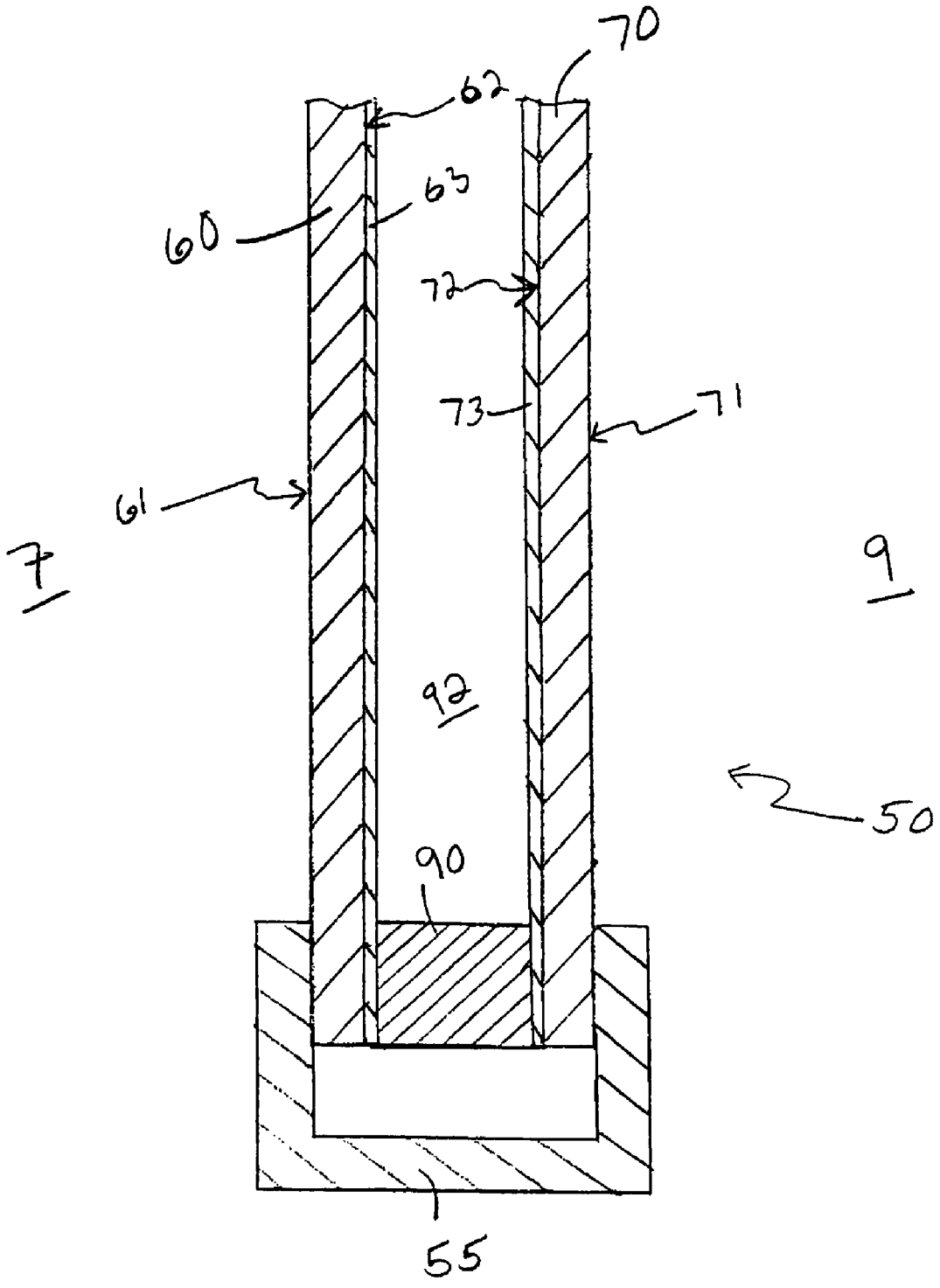
FIG. 4 is an illustration of a partial cross-sectional view of a refrigeration door according to the present invention.

In an alternative two pane embodiment of the present invention shown in FIG. 4, the IGU 50 includes an outer sheet 60 and inner sheet 70 of glass, the frame 55, and a sealant assembly 90. In this two-pane embodiment, both the outer sheet 60 and inner sheet 70 are one eighth of an inch thick and include the same low E coating as described in the first embodiment, which is titania based silver low E coating. Again, both the outer sheet 60 and inner sheet 70 may, for example, be a sheet of Comfort Ti-PS glass, one eighth of an inch thick, manufactured by AFG Industries, Inc. The coated sides of the sheets 60 and 70 are on the unexposed surfaces of the sheets, sides 62 and 72, respectively, which form part of the chamber 92. In addition, the same sealant assembly 90 described above (the Comfort Seal) may be used and acts to provide a spacing of one half inch between the outer 60 and inner 70 sheets of glass.

Table 2 below includes design parameters and the corresponding calculated U values for a number of two pane IGUs. In addition to the design parameters listed in the table below, all of the two pane calculations were computed with each pane being one eighth of an inch thick, and a total of two sides of the two panes being low E coated. Tempering of the glass does not significantly effect the calculated performance values.

TABLE 2

| Spacing between Sheets (inches) | Gas in Chambers | Type of Coating | Emissivity of IGU | U value (Btu/hr-sq ft-F) |
|---|---|---|---|---|
| 1/2 | air | Ti-PS | 0.0025 | 0.29 |
| 5/16 | air | Ti-PS | 0.0025 | 0.36 |
| 1/2 | argon | Ti-PS | 0.0025 | 0.23 |
| 5/16 | argon | Ti-PS | 0.0025 | 0.28 |
| 1/2 | krypton | Ti-PS | 0.0025 | 0.22 |
| 5/16 | krypton | Ti-PS | 0.0025 | 0.20 |
| 1/2 | air | CE2 | 0.04 | 0.32 |
| 5/16 | air | CE2 | 0.04 | 0.39 |
| 1/2 | argon | CE2 | 0.04 | 0.27 |
| 5/16 | argon | CE2 | 0.04 | 0.31 |
| 1/2 | krypton | CE2 | 0.04 | 0.26 |
| 5/16 | krypton | CE2 | 0.04 | 0.24 |

In alternative embodiments, any suitable type of coating processes may be employed including pyrolytic (e.g., as in the Comfort E2), which is often referred to as chemical vapor deposition (CVD), spray, and sputter coating (e.g., as in the Comfort Ti-PS). Furthermore, these processes may be applied using well-known off-line or on-line manufacturing methods as is suitable and appropriate for the quantity and type of production and process. Likewise, any suitable low E coating may be employed including silver based, titania based, or fluorine doped tin oxide coating.

Although the embodiments described above include low E coatings on the unexposed surfaces of two sheets of glass, other embodiments of the present invention might include a low E coating applied to only one sheet of glass on either side, or on both sides. Likewise, in other embodiments the middle sheet of glass (of a three pane embodiment) may include a low E coating on either side (or both sides) instead of, or in addition to, coatings on the inner sheet 70 and outer sheet 60 of glass.

In yet another three pane embodiment, the inner sheet of glass 70 does not have a low E coating on either side of the sheet of glass 7Q. Likewise, in an alternative to the two sheet embodiment described above, the low E coating is present on only one sheet, or on both sides of both sheets. In general, the number of sheets that have the low E coating and the side (or sides) that have the coating is a design choice. The total emissivity of the IGU, which along with other factors determines the U factor of the door, is more important with respect to the thermal performance than which side or sides of which sheet(s) are coated. In addition, although the embodiments described herein have emissivities of less than or equal to 0.04 for refrigeration door applications, using a high performance gas (such as krypton) may enable an IGU with an emissivity of slightly more than 0.04 to provide the necessary condensation control in some circumstances.

In other embodiments, other sealant assemblies may be employed including for example, an all-foam, non-metal assembly such as the Super Spacer, manufactured by EdgeTech, Inc, which has a heat transfer rate of approximately 1.51 Btu/hr-ft-F. Another suitable sealant assembly is the ThermoPlastic Spacersystem (TPS) manufactured by Lenhardt Maschinenbau GmbH, which has a heat transfer rate of approximately 1.73 Btu/hr-ft-F.

The spacing in the above disclosed embodiments is one half inch. However, while the preferred spacing ranges between five sixteenths of an inch to one half inch, other embodiments of the invention may use spacings up to three quarters of an inch. In addition, while the above disclosed embodiments employ glass one eighth of an inch thick that is tempered (except for the middle sheet), other embodiments may use untempered glass or thicknesses that are greater than, or less than, one eighth of an inch.

The design parameters of an embodiment of the present invention will be determined, in part, by the application or intended use of the embodiment. More specifically, the exterior ambient temperature, interior temperature, and exterior ambient humidity (and associated dew point) are important factors in determining the necessary U value for the design, which in turn, determines the design parameters (type of glass, emissivity, number of sheets, gas, etc.).

The left five columns of Table 3 below provide a list of calculated U values for various applications of the intended use and includes the exterior temperature, interior temperature, exterior humidity, and calculated dew point for each U value. In addition, the right three columns of Table 3 provide an embodiment of the invention that will provide the necessary U value.

TABLE 3

| Calculated U Values for Various Environmental Parameters | | | | | IGU Design Variables for Satisfying Identified U Value | | |
|---|---|---|---|---|---|---|---|
| Exterior Temp Deg F. | Interior Temp Deg F. | U Value Btu/ hr-sq ft-F. | Dewpoint (Outside Glass T) Deg F. | Maximum Relative Humidity Percent | Glass (Two Sheets) | Spacing Inches | Gas In Chambers |
| 80 | −40 | 0.19 | 64.9 | 60.1 | Ti-PS | 3/8 | air |
| 72 | 0 | 0.27 | 57.4 | 60 | CE2 | 5/16 | air |
| 80 | −40 | 0.15 | 67.6 | 66.0 | CE2 | 3/8 | krypton |
| 80 | −40 | 0.18 | 65.7 | 61.8 | CE2 | 3/8 | argon |
| 80 | −40 | 0.25 | 60.3 | 51.1 | CE2 | 3/8 | air |
| 80 | −40 | 0.16 | 67.3 | 65.3 | CE2 | 1/2 | krypton |
| 80 | −40 | 0.17 | 66.5 | 63.5 | CE2 | 1/2 | argon |
| 80 | −40 | 0.20 | 64.1 | 58.5 | CE2 | 1/2 | air |
| 80 | −40 | 0.11 | 70.6 | 73.1 | Ti-PS | 3/8 | krypton |
| 80 | −40 | 0.14 | 68.6 | 68.3 | Ti-PS | 3/8 | argon |
| 80 | −40 | 0.19 | 65.0 | 60.3 | Ti-PS | 3/8 | air |
| 80 | −40 | 0.12 | 70.2 | 72.1 | Ti-PS | 1/2 | krypton |
| 80 | −40 | 0.13 | 69.4 | 70.2 | Ti-PS | 1/2 | argon |
| 80 | −40 | 0.17 | 66.7 | 64.0 | Ti-PS | 1/2 | air |
| 72 | −10 | 0.18 | 61.2 | 68.9 | CE2 | 3/8 | argon |
| 72 | 0 | 0.18 | 62.1 | 71.1 | CE2 | 3/8 | argon |
| 72 | 10 | 0.18 | 63.0 | 73.4 | CE2 | 3/8 | argon |
| 70 | 0 | 0.18 | 60.3 | 71.4 | CE2 | 3/8 | argon |
| 80 | 0 | 0.18 | 69.2 | 69.7 | CE2 | 3/8 | argon |
| 90 | 0 | 0.18 | 78.1 | 68.3 | CE2 | 3/8 | argon |
| 70 | −20 | 0.21 | 55.5 | 60.1 | CE2 | 3/8 | air |
| 86 | −22 | 0.11 | 77.5 | 75.9 | Ti-PS | 3/8 | krypton |
| 80 | −40 | 0.19 | 65.0 | 60.3 | CE1 | 1/2 | air |
| 70 | 32 | 0.18 | 63.4 | 79.6 | CE2 | 3/8 | argon |
| 80 | 32 | 0.18 | 72.2 | 77.2 | CE2 | 3/8 | argon |
| 90 | 32 | 0.18 | 81.0 | 75.0 | CE2 | 3/8 | argon |

The design parameters of Table 3 identify the type of glass (which is one eighth of an inch thick), the spacing between sheets, and the gas in the chambers. In addition, all of the IGUs of the Table 3 include a third, non-coated sheet of glass that is one eighth of an inch thick, and that is disposed between the two sheets of glass identified in the table. CE1 in the Table 3 refers to Comfort E1, which has an emissivity of 0.35 and is sold by AFG Industries, Inc.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention.

While the application of the present invention has been described in the application of a refrigerator or freezer door, other applications might include vending machines, skylights, or refrigerated trucks. In some of these applications, condensation on the second or colder side of the glass may not be an issue because the glass is not in a door that is periodically opened exposing the cold glass to a more humid environment. As a result, the key factors in designing the glass are economics (i.e., the energy costs and the cost of the glass and its installation), visible transmittance, durability, and other considerations.

While a preferred embodiment of the present invention has been described above, it should be understood that it has been presented by way of example only, and not limitation. Thus, the breadth and scope of the present invention should not be limited by the above described exemplary embodiment.

Obviously, numerous modifications and variations of the present invention are possible in light of the above teachings. It is therefore to be understood that within the scope of the appended claims, the invention may be practiced otherwise than as specifically described herein.

What is claimed is:

1. A refrigeration door adapted for use in a refrigerating compartment, said door comprising:

an inner sheet of glass including a first surface and a second surface, said first surface of said inner sheet being disposed adjacent the interior of the refrigerating compartment;

an outer sheet of glass including a first surface and a second surface, said first surface of said outer sheet being disposed adjacent the exterior environment of the refrigerating compartment;

a middle sheet of glass disposed between said inner and outer sheets of glass;

a first sealant assembly disposed around the periphery of said inner sheet of glass and said middle sheet of glass for maintaining said inner sheet and said middle sheet in spaced-apart relationship from each other;

a second sealant assembly disposed around the periphery of said middle sheet of glass and said outer sheet of glass for maintaining said middle sheet and said outer sheet in spaced-apart relationship from each other;

a first low emissivity coating adjacent the second surface of said inner sheet of glass;

a second low emissivity coating adjacent the second surface of said outer sheet of glass;

said inner sheet, outer sheet, middle sheet, first sealant assembly, second sealant assembly, and said first and second low emissivity coatings forming an insulating glass unit having a U value substantially equal to or less than 0.2 BTU/hr-sq ft-F substantially preventing the formation of condensation on said first surface of said outer sheet of glass without the application of electricity for heating said first surface of said outer sheet of glass; and a frame secured around the periphery of said insulating glass unit.

2. The refrigeration door of claim 1, further comprising:

a first chamber defined by said inner sheet of glass, said middle sheet of glass, and said first sealant assembly;

a second chamber defined by said middle sheet of glass, said outer sheet of glass, and said second sealant assembly; and a gas disposed in each of said first and second chambers.

3. The refrigeration door of claim 2, wherein:

said inner, said middle, and said outer sheets of glass have a thickness substantially equal to one eighth of an inch;

said inner and said middle sheets of glass being spaced apart a distance substantially equal to one half inch; and said middle and said outer sheets of glass being spaced apart a distance substantially equal to one half inch.

4. The refrigeration door of claim 2, wherein said first sealant assembly and said second sealant assembly each have a heat transfer rate substantially equal to or less than 1.73 Btu/hr-ft-F.

5. The refrigeration door of claim 4, wherein:

said inner, said middle and said outer sheets of glass having a thickness substantially equal to one eighth of an inch;

said inner and said middle sheets of glass being spaced apart a distance substantially equal to one half inch; and said middle and said outer sheets of glass being spaced apart a distance substantially equal to one half inch.

6. The refrigeration door of claim 2, wherein said gas in said first chamber and said second chamber are the same.

7. The refrigeration door of claim 2, wherein said gas in said first chamber and said second chamber are not the same.

8. The refrigeration door of claim 2, wherein said gas is selected from the group consisting of argon, krypton, and air.

9. The refrigeration door of claim 2, wherein said first and second low emissivity coatings are selected from the group consisting of a titania based silver and fluorine doped tin oxide.

10. The refrigeration door of claim 2, wherein said first and second low emissivity coatings are applied with a process selected from the group consisting of sputter coating, pyrolytic coating and spray coating.

11. The refrigeration door of claim 2, wherein said frame is formed from a material selected from the group consisting of extruded plastic, aluminum, and fiber glass.

12. The refrigeration door of claim 1, wherein said insulating glass unit has a U value substantially equal to or less than 0.16 BTU/hr-sq ft-F.

13. The refrigeration door of claim 1, wherein said outer sheet and said inner sheet each have an emissivity substantially equal to or less than 0.05.

14. The refrigeration door of claim 1, wherein said outer sheet and said inner sheet each have an emissivity substantially equal to or less than 0.03.

15. The refrigeration door of claim 1, wherein said insulating glass unit has an emissivity substantially equal to or less than 0.04.

16. The refrigeration door of claim 1, wherein said insulating glass unit has an emissivity substantially equal to or less than 0.01.

17. The refrigeration door of claim 1, wherein said insulating glass unit has an emissivity substantially equal to or less than 0.0025.

18. The refrigeration door of claim 1, wherein the interior temperature of the refrigerating compartment is substantially equal to or less than minus twenty degrees Fahrenheit; the temperature of the exterior environment is substantially equal to or greater than seventy degrees Fahrenheit; and the humidity in the exterior environment is substantially equal to or greater than sixty percent; and wherein said first surface of said outer sheet of glass is substantially free of condensation.

19. The refrigeration door of claim 1, wherein the interior temperature of the refrigerating compartment is substantially equal to or less than minus forty degrees Fahrenheit; the temperature of the exterior environment is substantially equal to or greater than eighty degrees Fahrenheit; and the humidity in the exterior environment is substantially equal to or greater than sixty percent; and wherein said first surface of said outer sheet of glass is substantially free of condensation.

20. The refrigeration door of claim 1, wherein the interior temperature of the refrigerating compartment is substantially equal to or less than zero degrees Fahrenheit; the temperature of the exterior environment is substantially equal to or greater than seventy two degrees Fahrenheit; and the humidity in the ambient environment is substantially equal to or greater than sixty percent; and wherein said first surface of said outer sheet of glass is substantially free of condensation.

21. The refrigeration door of claim 1, wherein said first sealant assembly and said second sealant assembly each have a heat transfer rate substantially equal to or less than 1.73 Btu/hr-ft-F.

22. The refrigeration door of claim 1, wherein said first sealant assembly and said second sealant assembly each have a heat transfer rate substantially equal to or less than 1.51 Btu/hr-ft-F.

23. The refrigeration door of claim 1, wherein said first sealant assembly and said second sealant assembly each have a heat transfer rate substantially equal to or less than 0.84 Btu/hr-ft-F.

24. The refrigeration door of claim 1, wherein at least one of said first or second sealant assembly is a composite extrusion comprising a combination of polyisobutylene sealant, hot melt butyl sealant, desiccant matrix, rubber shim, and a vapor barrier.

25. The refrigeration door of claim 1, wherein at least one of said first or second sealant assembly is an all-foam assembly.

26. The refrigeration door of claim 1, wherein at least one of said first or second sealant assembly is a warm edge seal.

27. A refrigeration door adapted to be mounted on a refrigerating compartment, said door comprising:

an inner sheet of glass including a first surface and a second surface, said first surface of said inner sheet being disposed adjacent the interior of the refrigerating compartment;

an outer sheet of glass including a first surface and a second surface, said first surface of said outer sheet being disposed adjacent the exterior environment of the refrigerating compartment;

a middle sheet of glass disposed between said inner and outer sheets of glass;

a first sealant assembly disposed around the periphery of said inner sheet of glass and said middle sheet of glass for maintaining said inner sheet and said middle sheet in spaced-apart relationship from each other;

a second sealant assembly disposed around the periphery of said middle sheet of glass and said outer sheet of glass for maintaining said middle sheet and said outer sheet in spaced-apart relationship from each other;

a first low emissivity coating adjacent the second surface of said inner sheet of glass;

a second low emissivity coating adjacent the second surface of said outer sheet of glass;

said inner sheet, outer sheet, middle sheet, first sealant assembly, second sealant assembly, and said first and second low emissivity coatings forming an insulating glass unit having an emissivity substantially equal to or less than 0.04 substantially preventing the formation of condensation on said first surface of said outer sheet of glass without the application of electricity for heating said first surface of said outer sheet of glass; and a frame secured around the periphery of said insulating glass unit.

28. The refrigeration door of claim 27, further comprising:

a first chamber defined by said inner sheet of glass, said middle sheet of glass, and said first sealant assembly;

a second chamber defined by said middle sheet of glass, said outer sheet of glass, and said second sealant assembly; and a gas disposed in each of said first and second chambers.

29. The refrigeration door of claim 28, wherein:

said inner, said middle, and said outer sheets of glass have a thickness substantially equal to one eighth of an inch;

said inner and said middle sheets of glass being spaced apart a distance substantially equal to one half inch; and said middle and said outer sheets of glass being spaced apart a distance substantially equal to one half inch.

30. The refrigeration door of claim 28, wherein said gas is selected from the group consisting of argon, krypton, and air.

31. The refrigeration door of claim 28, wherein said low emissivity coatings are selected from the group consisting of a titania based silver and fluorine doped tin oxide.

32. The refrigeration door of claim 28, wherein said low emissivity coatings are applied with a process selected from the group consisting of sputter coating, pyrolytic coating and spray coating.

33. The refrigeration door of claim 28, wherein said frame is formed from a material selected from the group consisting of extruded plastic, aluminum, and fiber glass.

34. The refrigeration door of claim 27, wherein said insulating glass unit has a U value substantially equal to or less than 0.16 BTU/hr-sq ft-F.

35. The refrigeration door of claim 27, wherein said outer sheet and said inner sheet each have an emissivity substantially equal to or less than 0.05.

36. The refrigeration door of claim 27, wherein said outer sheet and said inner sheet each have an emissivity substantially equal to or less than 0.03.

37. The refrigeration door of claim 27, wherein said insulating glass unit has a U value substantially equal to or less than 0.2 BTU/hr-sq ft-F.

38. The refrigeration door of claim 27, wherein said insulating glass unit has an emissivity substantially equal to or less than 0.01.

39. The refrigeration door of claim 27, wherein said insulating glass unit has an emissivity substantially equal to or less than 0.0025.

40. The refrigeration door of claim 27, wherein the interior temperature of the refrigerating compartment is substantially equal to or less than minus twenty degrees Fahrenheit; the temperature of the exterior environment is substantially equal to or greater than seventy degrees Fahrenheit; and the humidity in the exterior environment is substantially equal to or greater than sixty percent; and wherein said first surface of said outer sheet of glass is substantially free of condensation.

41. The refrigeration door of claim 27, wherein the interior temperature of the refrigerating compartment is substantially equal to or less than minus forty degrees Fahrenheit; the temperature of the exterior environment is substantially equal to or greater than eighty degrees Fahrenheit; and the humidity in the exterior environment is substantially equal to or greater than sixty percent; and wherein said first surface of said outer sheet of glass is substantially free of condensation.

42. The refrigeration door of claim 27, wherein the interior temperature of the refrigerating compartment is substantially equal to or less than zero degrees Fahrenheit; the temperature of the exterior environment is substantially equal to or greater than seventy-two degrees Fahrenheit; and the humidity in the ambient environment is substantially equal to or greater than sixty percent; and wherein said first surface of said outer sheet of glass is substantially free of condensation.

43. The refrigeration door of claim 27, wherein said first sealant assembly and said second sealant assembly each have a heat transfer rate substantially equal to or less than 1.73 Btu/hr-ft-F.

44. The refrigeration door of claim 27, said wherein first sealant assembly and said second sealant assembly each have a heat transfer rate substantially equal to or less than 1.51 Btu/hr-ft-F.

45. The refrigeration door of claim 27, wherein said first sealant assembly and said second sealant assembly each have a heat transfer rate substantially equal to or less than 0.84 Btu/hr-ft-F.

46. The refrigeration door of claim 27, wherein at least one of said first or second sealant assembly is a composite extrusion comprising a combination of polyisobutylene sealant, hot melt butyl sealant, desiccant matrix, rubber shim, and a vapor barrier.

47. The refrigeration door of claim 27, wherein at least one of said first or second sealant assembly is an all-foam assembly.

48. The refrigeration door of claim 27, wherein at least one of said first or second sealant assembly is a warm edge seal.

49. A refrigeration door having an outer surface and adapted for use in a refrigerating compartment, said door comprising:

a first sheet of glass;

a second sheet of glass;

a first sealant assembly disposed around the periphery of said first sheet of glass and said second sheet of glass for maintaining said first sheet and said second sheet in spaced-apart relationship from each other;

a first low emissivity coating adjacent a surface of said first sheet or said second sheet of glass;

said first sheet and second sheets of glass, said first sealant assembly, and said first low emissivity coating forming an insulating glass unit having a U value substantially equal to or less than 0.2 BTU/hr-sq ft-F; and a frame secured around the periphery of said insulating glass unit.

50. The refrigerator door of claim 49, further comprising:

a third sheet of glass;

a second sealant assembly disposed around the periphery of said second sheet of glass and said third sheet of glass for maintaining said second sheet and said third sheet in spaced-apart relationship from each other; and wherein said insulating glass unit further includes said third sheet of glass and said second sealant assembly.

51. The refrigeration door of claim 50, further including a second low emissivity coating adjacent a surface of said first sheet, said second sheet, or said third sheet of glass.

52. The refrigeration door of claim 51, wherein the U value of said insulating glass unit is effective to substantially prevent the formation of condensation on the outer surface of the door without the application of electricity for heating the outer surface when the interior temperature of the refrigerating compartment is substantially equal to or less than zero degrees Fahrenheit; the temperature of the exterior environment is substantially equal to or greater than seventy-two degrees Fahrenheit; and the humidity in the ambient environment is substantially equal to or greater than sixty percent.

53. The refrigeration door of claim 49, wherein the U value of said insulating glass unit is effective to substantially prevent the formation of condensation on the outer surface of the door without the application of electricity for heating the outer surface when the interior temperature of the refrigerating compartment is substantially equal to or less than zero degrees Fahrenheit; the temperature of the exterior environment is substantially equal to or greater than seventy-two degrees Fahrenheit; and the humidity in the ambient environment is substantially equal to or greater than sixty percent.

54. The refrigeration door of claim 53, further comprising:

a first chamber defined by said first sheet of glass, said second sheet of glass, and said first sealant assembly; and a gas disposed in said first chamber.

55. The refrigeration door of claim 54, wherein said first sealant assembly has a heat transfer rate substantially equal to or less than 1.73 Btu/hr-ft-F.

56. The refrigeration door of claim 54, wherein said gas is selected from the group consisting of argon, krypton, and air.

57. The refrigeration door of claim 49, wherein said insulating glass unit has a U value substantially equal to or less than 0.16 BTU/hr-sq ft-F.

58. The refrigeration door of claim 49, wherein said insulating glass unit has an emissivity substantially equal to or less than 0.04.

59. The refrigeration door of claim 49, wherein said insulating glass unit has an emissivity substantially equal to or less than 0.01.

60. The refrigeration door of claim 49, wherein said insulating glass unit has an emissivity substantially equal to or less than 0.0025.

61. The refrigeration door of claim 49, wherein the interior temperature of the refrigerating compartment is substantially equal to or less than minus twenty degrees Fahrenheit; the temperature of the exterior environment is substantially equal to or greater than seventy degrees Fahrenheit; and the humidity in the exterior environment is substantially equal to or greater than sixty percent; and wherein the outer surface of the door is substantially free of condensation.

62. The refrigeration door of claim 49, wherein the interior temperature of the refrigerating compartment is substantially equal to or less than minus forty degrees Fahrenheit; the temperature of the exterior environment is substantially equal to or greater than eighty degrees Fahrenheit; and the humidity in the exterior environment is substantially equal to or greater than sixty percent; and wherein the outer surface of the door is substantially free of condensation.

63. The refrigeration door of claim 49, wherein said first sealant assembly is a composite extrusion comprising a combination of polyisobutylene sealant, hot melt butyl sealant, desiccant matrix, rubber shim, and a vapor barrier.

64. The refrigeration door of claim 49, wherein said first sealant assembly is an all-foam assembly.

65. The refrigeration door of claim 49, wherein said first sealant assembly is a warm edge seal.

66. A refrigeration door having an outside surface and adapted to be mounted on a refrigerating compartment, said door comprising:

a first sheet of glass;

a second sheet of glass;

a first sealant assembly disposed around the periphery of said first sheet of glass and said second sheet of glass for maintaining said first sheet and said second sheet in spaced-apart relationship from each other;

a first low emissivity coating adjacent a surface of said first sheet or said second sheet of glass;

said first sheet and second sheets of glass, said first sealant assembly, and said first low emissivity coating forming an insulating glass unit having an emissivity substantially equal to or less than 0.04 substantially preventing the formation of condensation on the outside surface of the refrigeration door without the application of electricity for heating said outer surface; and a frame secured around the periphery of said insulating glass unit; wherein the first sealant assembly is a non-metal sealant assembly.

67. The refrigeration door of claim 66, further comprising:

a third sheet of glass;

a second sealant assembly disposed around the periphery of said second sheet of glass and said third sheet of glass for maintaining said second sheet and said third sheet in spaced-apart relationship from each other; and wherein said insulating glass unit further includes said third sheet of glass and said second sealant assembly.

68. The refrigeration door of claim 67, further including a second low emissivity coating adjacent a surface of said first sheet, said second sheet, or said third sheet of glass.

69. The refrigeration door of claim 66, further comprising:

a first chamber defined by said first sheet of glass, said second sheet of glass, and said first sealant assembly; and a gas disposed in said first chamber.

70. The refrigeration door of claim 69, wherein said first sealant assembly has a heat transfer rate substantially equal to or less than 1.73 Btu/hr-ft-F.

71. The refrigeration door of claim 70, wherein said gas is selected from the group consisting of argon, krypton, and air.

72. The refrigeration door of claim 66, wherein said insulating glass unit has a U value substantially equal to or less than 0.16 BTU/hr-sq ft-F.

73. The refrigeration door of claim 66, wherein said insulating glass unit has a U value substantially equal to or less than 0.20 BTU/hr-sq ft-F.

74. The refrigeration door of claim 66, wherein said insulating glass unit has an emissivity substantially equal to or less than 0.01.

75. The refrigeration door of claim 66, wherein insulating glass unit has an emissivity substantially equal to or less than 0.0025.

76. The refrigeration door of claim 66, wherein said first sealant assembly is a composite extrusion comprising a combination of polyisobutylene sealant, hot melt butyl sealant, desiccant matrix, rubber shim, and a vapor barrier.

77. The refrigeration door of claim 66, wherein said first sealant assembly is an all-foam assembly.

78. The refrigeration door of claim 66, wherein said first sealant assembly is a warm edge seal.

79. A method of manufacturing a refrigeration door component having an outer surface, said method comprising the steps of:

providing a first sheet of glass providing a second sheet of glass;

providing a first low emissivity coating adjacent a surface of said first sheet of glass or said second sheet of glass;

disposing a first sealant assembly around the periphery of said first sheet of glass and said second sheet of glass to maintain said first sheet and said second sheet in spaced-apart relationship from each other; and said first sheet of glass, said second sheet of glass, and said first sealant assembly forming an insulating glass unit having a U value substantially equal to or less than 0.2 BTU/hr-sq ft-F substantially preventing the formation of condensation on the outer surface of the refrigeration door component without the application of electricity for heating the door component.

80. The method of claim 79, wherein said first sheet of glass, said second sheet of glass, and said first sealant assembly define a first chamber; and further comprising the step of disposing a gas in said first chamber.

81. The method of claim 80, wherein said gas is selected from the group consisting of argon, krypton, and air.

82. The method of claim 79, further comprising the steps of:

providing a third sheet of glass;

disposing a second sealant assembly disposed around the periphery of said second sheet of glass and said third of glass for maintaining said second sheet and said third sheet in spaced-apart relationship from each other; and wherein said insulating glass unit further includes said third sheet of glass and said second sealant assembly.

83. The method of claim 82, wherein said third sheet of glass includes a low emissivity coating adjacent a surface of said third sheet of glass.

84. The method of claim 82, wherein said first and second sealant assemblies have a heat transfer rate substantially equal to or less than 1.73 Btu/hr-ft-F.

85. The method of claim 79, wherein said first sealant assembly has a heat transfer rate substantially equal to or less than 1.73 Btu/hr-ft-F.

86. The method of claim 85, wherein:

said first and said second sheets of glass having a thickness substantially equal to one eighth of an inch; and said first and said second sheets of glass being spaced apart a distance substantially equal to one half inch.

87. The method of claim 79, further including the step of disposing said insulating glass unit in a door frame.

88. The method of claim 79, wherein said insulating glass unit has a U value substantially equal to or less than 0.16 BTU/hr-sq ft-F.

89. The method of claim 79, wherein said insulating glass unit has an emissivity substantially equal to or less than 0.04.

90. The method of claim 79, wherein said insulating glass unit has an emissivity substantially equal to or less than 0.01.

91. The method of claim 79, wherein said insulating glass unit has an emissivity substantially equal to or less than 0.0025.

92. The method of claim 79, wherein said low emissivity coating is selected from the group consisting of a titania based silver and fluorine doped tin oxide.

93. The method of claim 79, wherein said low emissivity coating is applied with a process selected from the group consisting of sputter coating, pyrolytic coating and spray coating.

94. The method of claim 79, wherein said first sealant assembly has a heat transfer rate substantially equal to or less than 1.51 Btu/hr-ft-F.

95. The method of claim 79, wherein said first sealant assembly has a heat transfer rate substantially equal to or less than 0.84 Btu/hr-ft-F.

96. The method of claim 79, wherein said first sealant assembly is a composite extrusion comprising a combination of polyisobutylene sealant, hot melt butyl sealant, desiccant matrix, rubber shim, and a vapor barrier.

97. The method of claim 79, wherein said first sealant assembly is an all-foam assembly.

98. The method of claim 79, wherein said first sealant assembly is a warm edge seal.

99. A method of manufacturing a refrigeration door component having an outer surface, said method comprising the steps of:

providing a first sheet of glass;

providing a second sheet of glass;

providing a first low emissivity coating adjacent a surface of said first sheet of glass or said second sheet of glass;

disposing a first sealant assembly around the periphery of said first sheet of glass and said second sheet of glass to maintain said first sheet and said second sheet in spaced-apart relationship from each other; and said first sheet of glass, said second sheet of glass, and said first sealant assembly forming an insulating glass unit having an emissivity substantially equal to or less than 0.04 substantially preventing the formation of condensation on the outer surface of the refrigeration door component without the application of electricity for heating the door component.

100. The method of claim 99, wherein said first sheet of glass, said second sheet of glass, and said first sealant assembly define a first chamber; and further comprising the step of disposing a gas in said first chamber.

101. The method of claim 100, further including the step of disposing said insulating glass unit in a door frame.

102. The method of claim 101, wherein said gas is selected from the group consisting of argon, krypton, and air.

103. The method of claim 99, further comprising the steps of:

providing a third sheet of glass;

disposing a second sealant assembly disposed around the periphery of said second sheet of glass and said third of glass for maintaining said second sheet and said third sheet in spaced-apart relationship from each other; and wherein said insulating glass unit further includes said third sheet of glass and said second sealant assembly.

104. The method of claim 103, wherein said third sheet of glass includes a low emissivity coating adjacent a surface of said third sheet of glass.

105. The method of claim 103, wherein said first and second sealant assemblies have a heat transfer rate substantially equal to or less than 1.73 Btu/hr-ft-F.

106. The method of claim 99, wherein said first sealant assembly has a heat transfer rate substantially equal to or less than 1.73 Btu/hr-ft-F.

107. The method of claim 99, further including the step of disposing said insulating glass unit in a door frame.

108. The method of claim 99, wherein said insulating glass unit has a U value substantially equal to or less than 0.2 BTU/hr-sq ft-F.

109. The method of claim 99, wherein said insulating glass unit has an emissivity substantially equal to or less than 0.01.

110. The method of claim 99, wherein said insulating glass unit has an emissivity substantially equal to or less than 0.0025.

111. The method of claim 99, wherein said first sealant assembly has a heat transfer rate substantially equal to or less than 1.51 Btu/hr-ft-F.

112. The method of claim 99, wherein said first sealant assembly has a heat transfer rate substantially equal to or less than 0.84 Btu/hr-ft-F.

113. The method of claim 99, wherein said first sealant assembly is a composite extrusion comprising a combination of polyisobutylene sealant, hot melt butyl sealant, desiccant matrix, rubber shim, and a vapor barrier.

114. The method of claim 99, wherein said first sealant assembly is an all-foam assembly.

115. The method of claim 99, wherein said first sealant assembly is a warm edge seal.

116. A substantially transparent insulating glass unit door having an outer surface and being for use with a refrigerating compartment residing in an exterior environment and having an interior refrigerating compartment; said insulating glass unit door comprising:

a first sheet of glass;

a second sheet of glass;

a first sealant assembly disposed around the periphery of said first sheet of glass and said second sheet of glass for maintaining said first sheet and said second sheet in spaced-apart relationship from each other;

a first low emissivity coating adjacent a surface of said first sheet or said second sheet of glass, and said first sheet of glass, said second sheet of glass, and said first sealant assembly providing the insulating glass unit with a U value substantially equal to or less than 0.2 BTU/hr-sq ft-F effective to substantially prevent the formation condensation on the outer surface without the application of a electricity to heat the outer surface of the insulating glass unit when the interior temperature of the refrigerating compartment is substantially equal to or less than zero degrees Fahrenheit; the temperature of the exterior environment is substantially equal to or greater than seventy degrees Fahrenheit; and the humidity in the exterior environment is substantially equal to or greater than sixty percent.

117. The door of claim 104, further comprising:

a third sheet of glass; and a second sealant assembly disposed around the periphery of said second sheet of glass and said third of glass for maintaining said first sheet and said second sheet in spaced-apart relationship from each other.

118. The door of claim 117, further including a second low emissivity coating adjacent a surface of said first sheet, said second sheet or said third sheet of glass.

119. The door of claim 118 wherein the insulating glass unit has a U value that substantially prevents the formation condensation on the outer surface when the interior temperature of the refrigerating compartment is substantially equal to or less than minus forty degrees Fahrenheit; the temperature of the exterior environment is at substantially equal to or greater than eighty degrees Fahrenheit; and the humidity in the exterior environment is substantially equal to or greater than sixty percent.

120. The door of claim 118, wherein said low emissivity coating is effective to cause the insulating glass unit to have a U value substantially equal to or less than 0.2 BTU/hr-sq ft-F.

121. The door of claim 117, wherein said first sealant assembly and said second sealant assembly each have a heat transfer rate substantially equal to or less than 1.73 Btu/hr-ft-F.

122. The door of claim 117, wherein said first sealant assembly and said second sealant assembly each have a heat transfer rate substantially equal to or less than 1.73 Btu/hr-ft-F.

123. The door of claim 116, wherein the insulating glass unit has a U value substantially equal to or less than 0.16 BTU/hr-sq ft-F.

124. The door of claim 116, wherein said first sheet or second sheet has an emissivity substantially equal to or less than 0.05.

125. The door of claim 116, wherein the insulating glass unit has an emissivity substantially equal to or less than 0.04.

126. The door of claim 116, wherein the insulating glass unit has an emissivity substantially equal to or less than 0.01.

127. The door of claim 116, wherein the interior temperature of the refrigerating compartment is substantially equal to or less than minus twenty degrees Fahrenheit; the temperature of the exterior environment is substantially equal to or greater than seventy degrees Fahrenheit; and the humidity in the exterior environment is substantially equal to or greater than sixty percent.

128. The door of claim 116, wherein the interior temperature of the refrigerating compartment is substantially equal to or less than minus forty degrees Fahrenheit; the temperature of the exterior environment is substantially equal to or greater than eighty degrees Fahrenheit; and the humidity in the exterior environment is substantially equal to or greater than sixty percent.

129. The insulating glass door of claim 116, wherein said first sealant assembly is a composite extrusion comprising a combination of polyisobutylene sealant, hot melt butyl sealant, desiccant matrix, rubber shim, and a vapor barrier.

130. The insulating glass door of claim 116, wherein said first sealant assembly is an all-foam assembly.

131. The insulating glass door of claim 116, wherein said first sealant assembly is a warm edge seal.

132. A refrigeration unit including an insulated enclosure defining a compartment, a cooling system, and a door adapted to be mounted on an opening of said compartment, said door having an outer surface and comprising:

a first sheet of glass;

a second sheet of glass;

a first sealant assembly disposed around the periphery of said first sheet of glass and said second sheet of glass for maintaining said first sheet and said second sheet in spaced-apart relationship from each other;

a first low emissivity coating adjacent the a surface of said first or said second sheet of glass;

said first sheet, second sheet, first sealant assembly, and said first low emissivity coating forming an insulating glass unit having a U value substantially equal to or less than 0.2. BTU/hr-sq ft-F substantially preventing the formation of condensation on the outer surface of the door without the application of electricity for heating said first surface; and a frame secured around the periphery of said insulating glass unit.

133. The refrigeration unit of claim 132, further comprising:

a third sheet of glass; and a second sealant assembly disposed around the periphery of said second sheet of glass and said third of glass for maintaining said second sheet and said third sheet in spaced-apart relationship from each other.

134. The refrigeration unit of claim 133, wherein said first sealant assembly and said second sealant assembly each have a heat transfer rate substantially equal to or less than 1.73 Btu/hr-ft-F.

135. The refrigeration unit of claim 132, further comprising:

a first chamber defined by said first sheet of glass, said second sheet of glass, and said first sealant assembly;

a second chamber defined by said middle sheet of glass, said outer sheet of glass, and said second sealant assembly; and a gas disposed in each of said first and second chambers.

136. The refrigeration unit of claim 132, wherein the refrigeration door has an emissivity substantially equal to or less than 0.04.

137. The refrigeration unit of claim 132, wherein the refrigeration door has an emissivity substantially equal to or less than 0.01.

138. The refrigeration unit of claim 132, wherein said first sealant assembly has a heat transfer rate substantially equal to or less than 1.73 Btu/hr-ft-F.

139. The refrigeration unit of claim 132, wherein said first sealant assembly is a composite extrusion comprising a combination of polyisobutylene sealant, hot melt butyl sealant, desiccant matrix, rubber shim, and a vapor barrier.

140. The refrigeration unit of claim 132, wherein said first sealant assembly is an all-foam assembly.

141. The refrigeration unit of claim 132, wherein said first sealant assembly is a warm edge seal.

* * * * *